US008662089B2

(12) United States Patent
Hwang

(10) Patent No.: US 8,662,089 B2
(45) Date of Patent: Mar. 4, 2014

(54) NAIL-CLEANING TOOL

(71) Applicant: Beauty Promotions Inc., Incheon (KR)

(72) Inventor: Yong Bum Hwang, Incheon (KR)

(73) Assignee: Beauty Promotions Inc., Incheon (KR)

( * ) Notice: Subject to any disclaimer, the term of this patent is extended or adjusted under 35 U.S.C. 154(b) by 0 days.

(21) Appl. No.: 13/652,626

(22) Filed: Oct. 16, 2012

(65) Prior Publication Data

US 2013/0133677 A1 May 30, 2013

(30) Foreign Application Priority Data

Nov. 29, 2011 (KR) ..... 20-2011-0010582

(51) Int. Cl.

| | |
|---|---|
| ***A45D 29/18*** | (2006.01) |
| ***A45D 7/00*** | (2006.01) |
| ***A45D 40/26*** | (2006.01) |
| ***B43K 5/00*** | (2006.01) |
| ***B43M 11/06*** | (2006.01) |
| ***B43K 27/04*** | (2006.01) |
| ***B43K 27/08*** | (2006.01) |
| ***A47L 1/08*** | (2006.01) |
| ***A47L 13/00*** | (2006.01) |

(52) U.S. Cl.

USPC ..... 132/74.5; 132/200; 132/76.4; 132/320; 401/198; 401/35; 401/138

(58) Field of Classification Search

USPC ..... 132/74.5, 73, 73.5, 75.3, 75.6, 76.4, 132/76.5, 313, 317, 318, 320, 104, 108, 132/112, 113, 114, 200; 401/9, 10, 16, 19, 401/20, 23, 25, 27, 34, 35, 195, 49, 103, 401/223, 235, 199, 206, 266, 261, 264, 240, 401/138, 203, 205, 139, 198; 15/167.1, 15/167.3, 209.1

See application file for complete search history.

(56) References Cited

U.S. PATENT DOCUMENTS

| | | | | | |
|---|---|---|---|---|---|
| 1,362,601 | A | * | 12/1920 | Chandler | 132/74.5 |
| 1,715,914 | A | * | 6/1929 | Halk | 132/73 |
| 2,399,463 | A | * | 4/1946 | Bryant | 132/74.5 |
| 2,512,100 | A | * | 6/1950 | Haber | 132/74.5 |
| 2,517,283 | A | * | 8/1950 | Bryant | 401/198 |
| 2,550,890 | A | * | 5/1951 | Vaughn | 132/74.5 |
| 3,130,433 | A | * | 4/1964 | John | 401/261 |
| 3,825,021 | A | * | 7/1974 | Seidler | 132/320 |
| 4,622,985 | A | * | 11/1986 | Jankewitz | 132/319 |
| 5,960,802 | A | * | 10/1999 | Sakai | 132/320 |

(Continued)

FOREIGN PATENT DOCUMENTS

KR 10-2010-0130738 A 12/2010

*Primary Examiner* — Vanitha Elgart

(74) *Attorney, Agent, or Firm* — Bachman & LaPointe, P.C.

(57) ABSTRACT

The nail-cleaning tool 1000 has a body part 100 and the body part 100 has an oil reservoir 80 therein. An abrasive member 10 and a nib 20 are protruded from the body part 100. The nib 20 is connected to the oil reservoir 80 so that oil is supplied to the nib 20 from the oil reservoir 80, and the nib 20 and the abrasive member 10 are aligned to be in contact with each other by their faces along the longitudinal direction of the body part 100.

9 Claims, 5 Drawing Sheets

(56) References Cited

U.S. PATENT DOCUMENTS

| | | | | |
|---|---|---|---|---|
| 7,156,573 | B2 * | 1/2007 | Bedhome | 401/198 |
| 7,785,026 | B2 * | 8/2010 | Eng et al. | 401/37 |
| 8,161,983 | B1 * | 4/2012 | Lee | 132/324 |
| 2002/0127046 | A1 * | 9/2002 | Gueret | 401/266 |
| 2004/0031500 | A1 * | 2/2004 | Reyzis | 132/200 |
| 2005/0217685 | A1 * | 10/2005 | Burkholz et al. | 132/74.5 |
| 2007/0227553 | A1 * | 10/2007 | Gueret | 132/320 |
| 2007/0251541 | A1 * | 11/2007 | Nasu et al. | 132/320 |
| 2007/0251542 | A1 * | 11/2007 | Tajima | 132/320 |
| 2009/0317432 | A1 * | 12/2009 | Kergosien | 424/401 |

* cited by examiner

NAIL-CLEANING TOOL

CROSS-REFERENCE TO RELATED APPLICATION

Priority is claimed of KR20-2011-0010582, filed Nov. 29, 2011, the disclosure of which is incorporated by reference herein in its entirety as if set forth at length.

BACKGROUND OF THE INVENTION

The present invention relates to a nail-cleaning tool and, more particularly, to a nail-cleaning tool that can simply and efficiently remove dead skin cells or cuticles etc of the nail and clean it.

For nail art or for hygiene, it is necessary to remove dead skin cells or cuticles of the nails or of the toenails. Generally, it proceeds to push up the cuticles and remove them, after that, oil is applied to the removed place. In this case, special tools are necessary at each of the steps.

This applicant found Korean patent open-laid publication No. 10-2010-0130738 that provides a cleaning tool by which it is possible to simply and easily remove the cuticles of the nails.

This has a body part having a shape of a pen, and an oil reservoir reserving oil is installed in the body part. An abrasive member which is porous is protruded from the body part to the outside, and one end of the abrasive member is connected to the oil reservoir in the body part so that the oil in the oil reservoir is supplied to the abrasive member through the porous holes of the abrasive member.

Holding the body part and rubbing the abrasive member against the nail, the cuticles are removed as the oil is supplied to the nail through the porous holes of the abrasive member from the oil reservoir.

According to the open laid patent publication, the abrasive member must be porous because the oil should be supplied through the porous holes of the abrasive member. In this case, there is a possibility that the oil is not supplied well and, the possibility becomes higher as the viscosity of the oil becomes high.

SUMMARY OF THE INVENTION

As a result, a nail-cleaning tool that is not limited to have the porous abrasive member and where the smooth supply of the oil is guaranteed is desired. The present invention satisfies the demand.

The purpose of the present invention is to provide a nail-cleaning tool that can effectively clean the nail with simple constitution. In one aspect of the present invention, the purpose is directed to provide the nail-cleaning tool that is not limited to have the porous abrasive member and that guarantees the smooth supply of the oil.

One aspect of the present invention provides a nail-cleaning tool comprising: a body part having an oil reservoir therein; an abrasive member protruded from the body part; and a nib protruded from the body part; wherein, the nib is connected to the oil reservoir so that oil is supplied to the nib from the oil reservoir, and the nib and the abrasive member are aligned to be contact with each other by their faces along the longitudinal direction of the body part.

In some embodiments, the contact may be direct without any intervening member.

In some embodiments, the nib is arranged to go through a through-hole on the center of the abrasive member so that the nib is in contact with the inner face of the through-hole around its outer face.

In some embodiments, the abrasive member and the nib are adjoined each other and their adjoined faces are in contact with each other.

In some embodiments, the external end surfaces of the nib and the abrasive member are continuous and form a plane.

In some embodiments, the plane is inclined.

In some embodiments, the nib and the abrasive member are installed into the body part by a holder inserted into the body part.

The present invention provides a nail-cleaning tool that can effectively clean the nail with simple constitution. According to the present invention, the abrasive member need not be porous and the oil is supplied smoothly.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

The embodiments of the present invention will be described with reference to the drawings.

Figure 1:
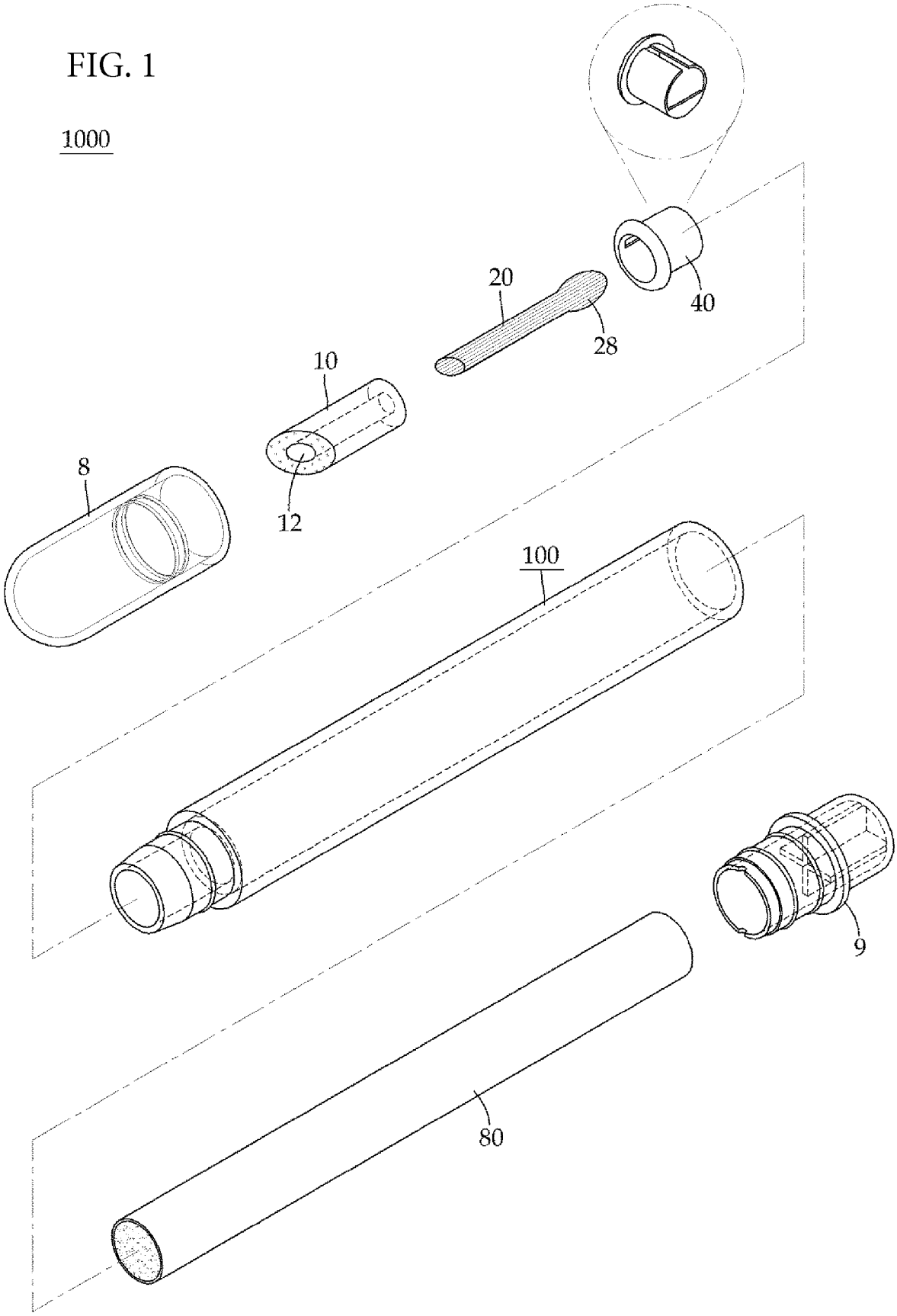
FIG. 1 is a disassembled perspective view of a nail-cleaning tool according to an embodiment of the present invention.
Figure 2:
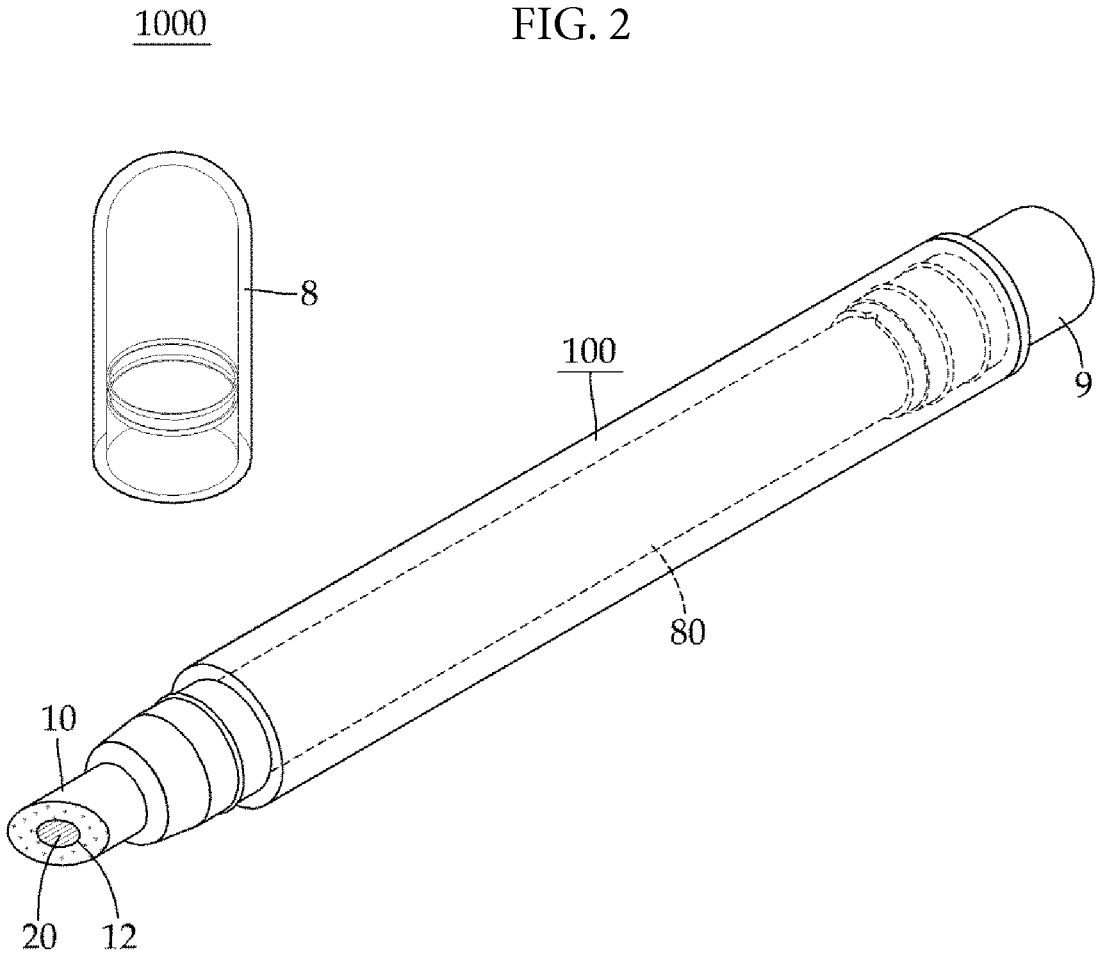
FIG. 2 is an assembled view of the nail-cleaning tool.
Figure 3:
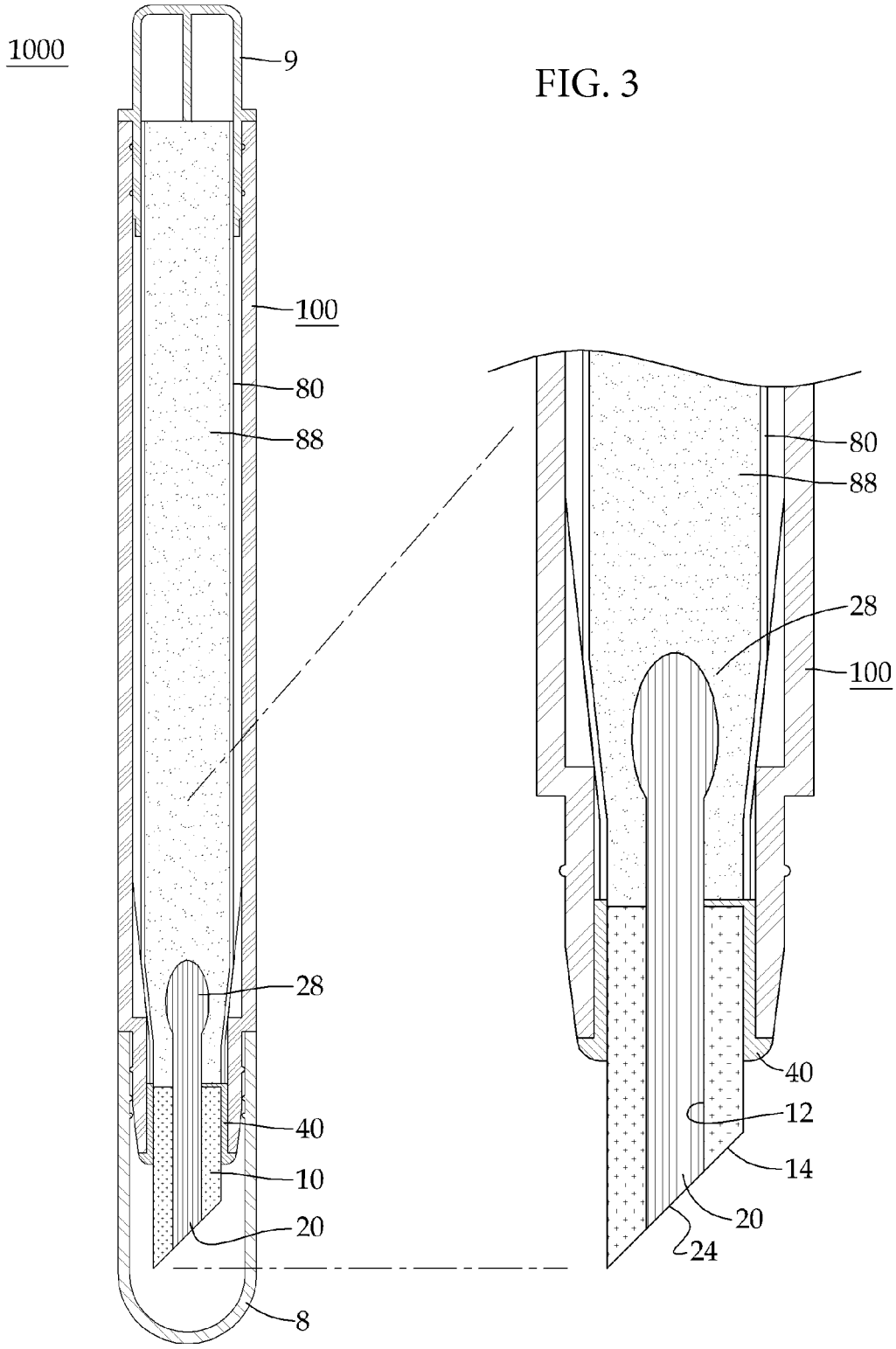
FIG. 3 is a central longitudinal sectional view of the nail-cleaning tool.

FIG. 1 is a disassembled perspective view of a nail-cleaning tool 1000 according to an embodiment of the present invention, FIG. 2 is an assembled view of the nail-cleaning tool 1000 and FIG. 3 is a sectional view of the nail cleaning tool 1000.

The nail-cleaning tool 1000 according to the embodiment of the present invention has a body part 100, and an oil reservoir 80 is installed in the body part 100.

The oil reservoir 80 reserves oil. For example, the oil reservoir 80 has a tube filled with fibers 88 made of polyester where the oil is reserved. The oil reservoir 80 may contain humectants as well as the oil.

An abrasive member 10 and a nib 20 are protruded from the body part 100 and the abrasive member 10 and the nib 20 are arranged to be contact with each other in their faces along the longitudinal direction of the body part 100.

Various materials can be used for the abrasive material 10 and it need not be porous. The mesh (abrasive particle size) can be various and, generally, what is used for polishing is appropriate.

The ceramic can be used for the material of the abrasive member 10 as the Korean laid open publication No. 10-2010-0130738 discloses.

The material produced by burning the mixture of the abrasive powder such as emery powder and the feldspar also can be used. The following shows processes to make the abrasive member 10 as an example.

1st step: Mixing aluminum oxide and feldspar: Mixing aluminum oxide (Haedong commercials, model No. 80) and feldspar (Duckyu ceramics Co., Ltd, India Potash Feldspar) at a ratio of 5:5 to 7:3 by weight.

2nd step: Placing the mixture into mold and pressing it: Placing the mixture into the mold and pressing it.

3rd step: Burning: Burning the mixture shaped by the pressing in the mold (e.g., at a temperature of 1300° C. by means of an electric kiln).

4th step: Working process: Working the burned thing into the abrasive member.

The nib 20 may be manufactured by cutting a rod-shaped precursor processed by pressing multiple polyester threads (or fibers) or nylon threads (or fibers) with heat, the polyester threads or nylon threads being drawn lengthily. This nib has the internal structure that the polyester threads or nylon threads are densely aligned. Generally, a nib as used in a highlighter-pen can be used.

In this embodiment, the nib 20 goes through a through-hole 12 in the center of the abrasive member 20 so that the nib 20 is in contact with the inner face of the through-hole 12 around its outer face. The exemplary contact is direct without any intervening layer or other member. The exemplary contact is of exactly longitudinally-extending surfaces (e.g., of a circular cylindrical nib outer face and circular cylindrical through-hole inner face).

The abrasive member 10 and the nib 20 are installed into the body part 100 by a holder 40 inserted into the body part 100. As the abrasive member 10 and the nib 20 are arranged to be contact with each other in their faces along the longitudinal direction of the body part 100, they are supported by each other and, therefore, the strength is kept when the nail-cleaning tool 1000 is cleaning the nail.

The nib 20 extends longer than the abrasive member 20 and a rear part 28 of the nib 20 is inserted into the oil reservoir 80 so that the oil is supplied to the nib 20 from the oil reservoir 80.

It is desirable that the external end surfaces 24 and 14 of the nib 20 and the abrasive member 10 are continuous with each other and form a single plane so that the plane contacts the surface of the nail as the nail-cleaning tool 1000 moves on the nail.

In this case, it is more desirable if the plane is inclined.

Figure 4:
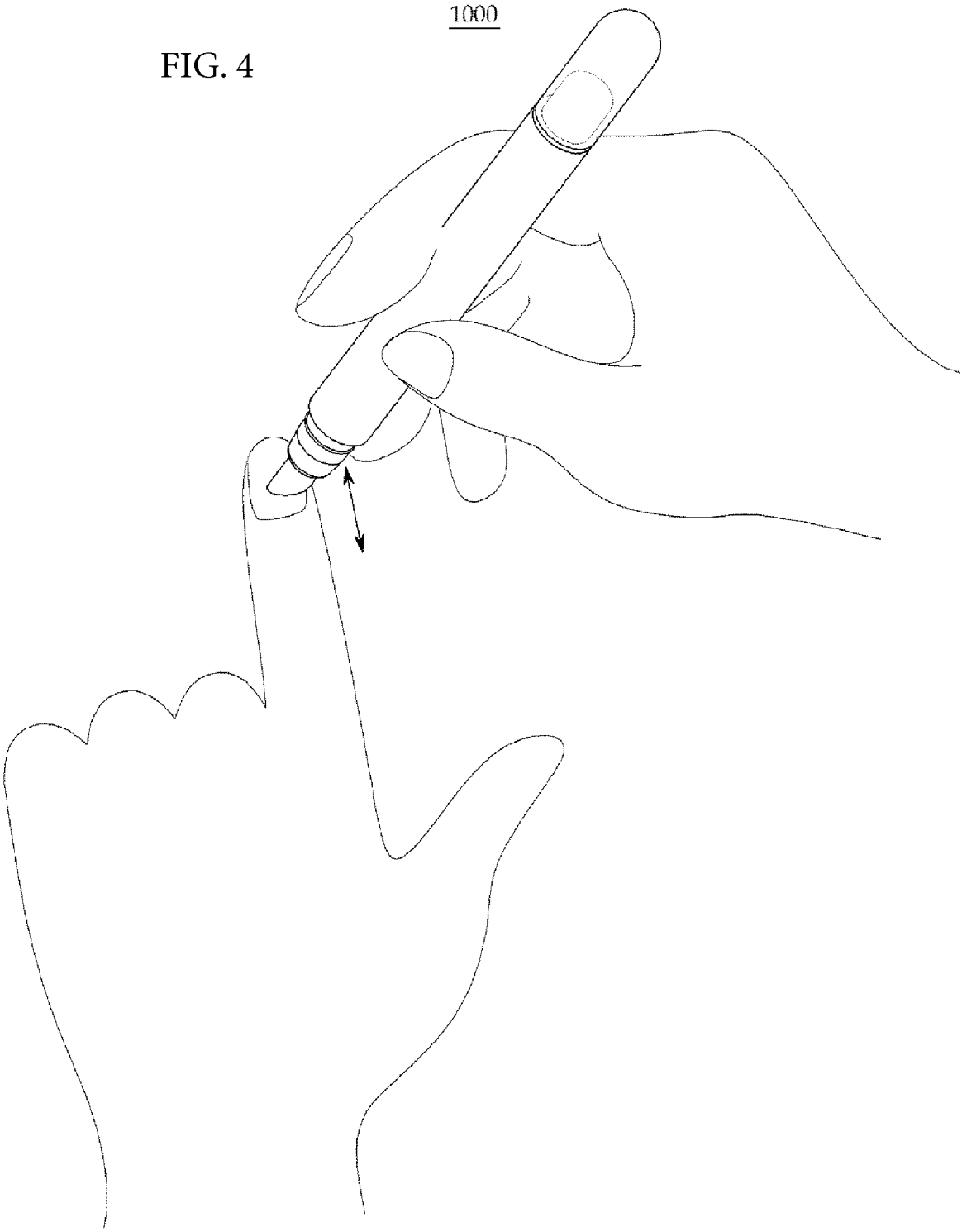
FIG. 4 is a view showing how to use the nail-cleaning tool.

As shown in FIG. 4, the nail cleaning tool 1000 is used by placing the continuous plane formed by the external end surfaces 14 and 24 of the abrasive member 10 and the nib 20 to contact with the surface of the nail and rubbing it. In this case, the abrasive member 10 abrades the nail surface while the oil is supplied to the nail through the nib 20 and the nail cleaning tool 1000 cleans the nail.

Figure 5:
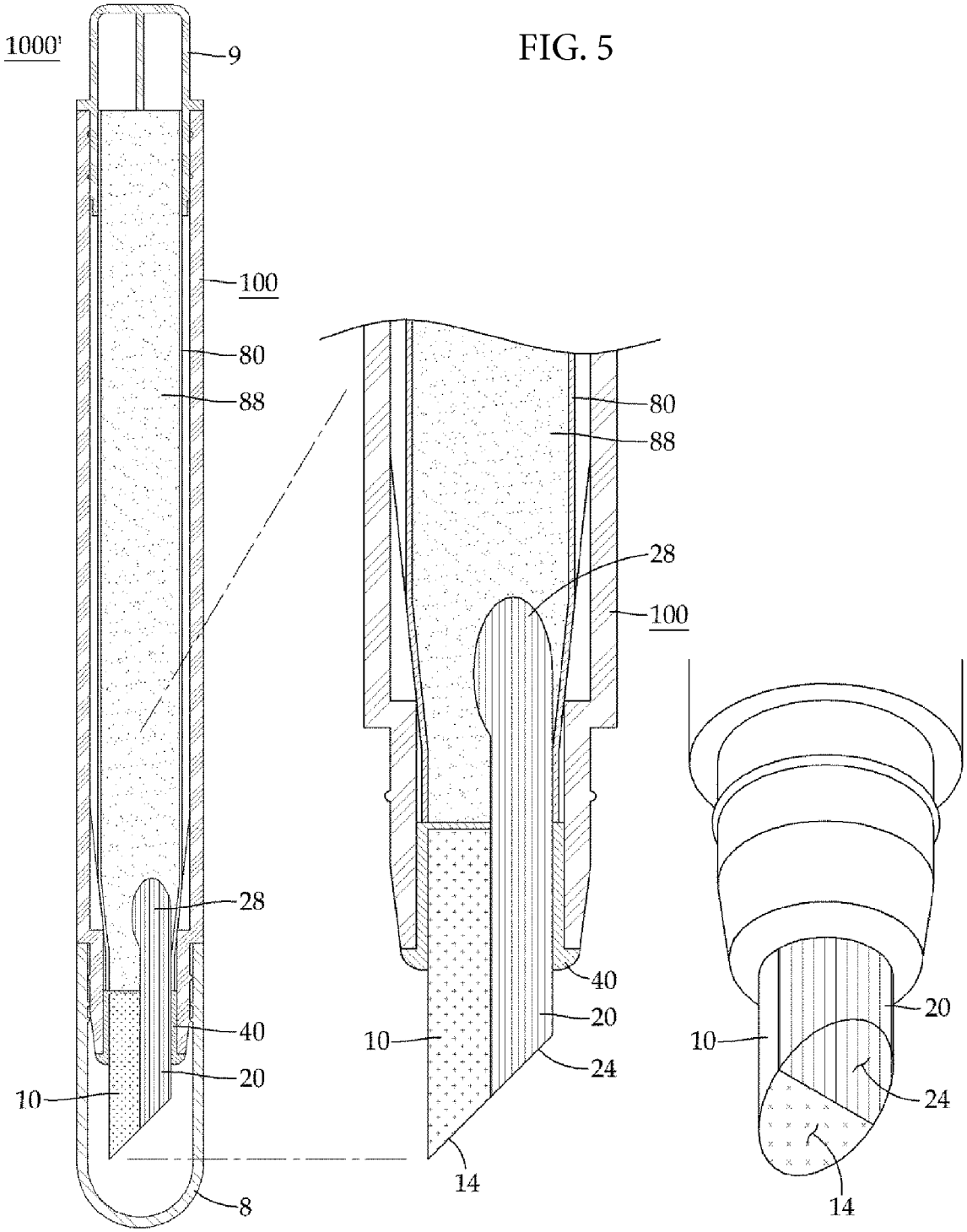
FIG. 5 is a view showing a nail cleaning tool according to another embodiment of the present invention.

FIG. 5 shows a nail-cleaning tool 1000' according to another embodiment of the present invention wherein the abrasive member and nib are side-by-side rather than the latter being received in a channel of the former. The main portions of the abrasive member and nib are of semi-circular section. In this case, the abrasive member 10 and the nib 20 are adjoined each other and their adjoined faces (formed by chords of the semicircles) are in contact with each other.

The number 8 refers to a cap and the number 9 refers to a plug to cover the rear part of the body part 100.

As described above, the nail-cleaning tools 1000 and 1000' have a simple constitution and the oil is supplied to the nail smoothly regardless of the porosity of the abrasive member. Accordingly, it is possible to simply and efficiently clean the nail.

What is claimed is:

1. A nail-cleaning tool comprising:

(a) a body part having an oil reservoir therein;

(b) an abrasive member for abrading a surface of a nail, the abrasive member protruded from the body part; and (c) a nib for providing oil to the surface of the nail, the nib protruded from the body part;

wherein, the nib is connected to the oil reservoir so that the oil is supplied to the nib from the oil reservoir, and external end surfaces of the nib and the abrasive member are continuous and form a plane, wherein:

the nib and the abrasive member are aligned to be in contact with each other by their faces along the longitudinal direction of the body part;

the contact is of planar surfaces of the abrasive member and nib; and the planar surfaces form a chord of a cross-section of the abrasive member and nib.

2. The nail-cleaning tool as claimed in claim 1 wherein the contact is direct.

3. The nail-cleaning tool as claimed in claim 1 wherein the plane is inclined.

4. The nail-cleaning tool as claimed in claim 3 wherein the nib and the abrasive member are installed into the body part by a holder inserted into the body part.

5. The nail-cleaning tool as claimed in claim 1 wherein the abrasive member and the nib are adjoined each other and their adjoined faces are in contact with each other.

6. The nail-cleaning tool as claimed in claim 1 wherein the abrasive member is a ceramic.

7. The nail-cleaning tool as claimed in claim 6 wherein the abrasive member is porous.

8. The nail-cleaning tool as claimed in claim 1 wherein the abrasive member is porous.

9. A method for using the tool of claim 1, the method comprising:

contacting a surface of a nail with the abrasive member and the nib; and rubbing the nail with the tool so that the abrasive member abrades the nail surface while the oil is supplied to the nail through the nib to clean the nail.

* * * * *